US005664619A

United States Patent [19]

Andersson et al.

[11] Patent Number: 5,664,619

[45] Date of Patent: Sep. 9, 1997

[54] DEVICE IN CONTINUOUS CASTING IN A MOULD

[75] Inventors: Erland Andersson, Ängelholm; Jan-Erik Eriksson, Västerås; Magnus Hallefält, Ängelholm; Sten Kollberg, Västerås; Erik Svensson, Västerås; Göte Tallbäck, Västerås, all of Sweden

[73] Assignee: Asea Brown Boveri AB, Västerås, Sweden

[21] Appl. No.: 454,308

[22] PCT Filed: Jan. 4, 1994

[86] PCT No.: PCT/SE94/00005

§ 371 Date: Jun. 19, 1995

§ 102(e) Date: Jun. 19, 1995

[87] PCT Pub. No.: WO94/16844

PCT Pub. Date: Aug. 4, 1994

[30] Foreign Application Priority Data

Jan. 19, 1993 [SE] Sweden ..... 9300149

[51] Int. Cl.[6] ..... B22D 27/02

[52] U.S. Cl. ..... 164/502; 164/466

[58] Field of Search ..... 164/466, 467, 164/468, 502, 503, 504, 147.1, 498, 499, 500

[56] References Cited

FOREIGN PATENT DOCUMENTS 1-289550 11/1989 Japan ..... 164/504

*Primary Examiner*—Kuang Y. Lin

*Attorney, Agent, or Firm*—Watson Cole Stevens Davis, P.L.L.C.

[57] ABSTRACT

A device for continuously manufacturing a cast strand by continuous casting of liquid metal melt wherein the flow of the liquid metal in the non-solidified portions of the strand is controlled by means of a static or periodic low-frequency magnetic field. A mould adapted to be supplied with the melt includes copper plates (2a,2b) which form a casting mould space with a rectangular cross section, water box beams (3) which are arranged outside the copper plates to support and cool them, and a member (4) holding the mould together. Magnetic field-generating devices, i.e., magnets, are provided close to the mould to generate a static or periodic low-frequency magnetic field which acts in the path of the inflowing melt and divides the primary flow as well as checks any secondary flows arising. Each magnet comprises a front core (5), a rear core and a coil (7). The front core is a fully integral part of the water box beam and the rear core comprises a rear movable part (6b) which is movable in a direction which substantially coincides with the direction of the field.

6 Claims, 4 Drawing Sheets

DEVICE IN CONTINUOUS CASTING IN A MOULD

TECHNICAL FIELD

The invention relates to a device for continuous manufacturing of a cast strand by continuous casting of liquid metal melt in which the flow of the liquid metal in non-solidified portions of the strand is controlled with the aid of a static or periodic low-frequency magnetic field.

BACKGROUND ART

In continuous casting a hot melt flows into a mould. In the mould the melt is cooled such that a solidified self-supporting surface layer is formed before the strand leaves the mould. If inflowing melt is allowed to flow into the mould in an uncontrolled manner, it will penetrate deep down into the non-solidified portions of the strand. This makes the separation of unwanted particles contained in the melt difficult. In addition, the self-supporting surface layer is weakened, which increases the risk of the melt breaking through the surface layer formed in the mould.

From, for example, SE-B-436 251, it is known to arrange one or more static or periodic low-frequency magnetic fields in the path of the melt to brake and distribute the inflowing melt.

The cast strand is formed by melt running down into the mould which is open downwards. The cast strand, which after the mould is to have a largely rectangular cross section, is formed by allowing the melt to flow into a tubular casting mould with a corresponding rectangular cross section, arranged in the mould. The walls of the casting mould consist of four separate copper plates. The copper plates are each fixed to a water box beam. The task of the water box beam is to stiffen the copper plate and, together with the copper plate, to enclose circulating cooling water.

When starting the casting operation, the mould is opened by hydraulic pistons pulling apart the copper plates and the associated water box beams such that a starting chain can be inserted between the copper plates. The mould is closed by the pistons pressing back the copper plates, which surround the starting chain.

The water box beams are surrounded by a retaining framework, to which the hydraulic pistons are attached. The water box beam with the copper plate constitute the movable side of the mould whereas the framework constitutes the fixed side.

According to patent application 9100184-2, the static or periodic low-frequency magnetic field is generated by means of magnetic field-generating devices which may consist of permanent magnets or coils, supplied with current, with magnetic cores. The magnetic field-generating devices will be referred to in the following as magnets.

The arrangement of the magnets in an existing machine for continuous casting will be described in the following.

The magnets have been arranged in the mould, between the water box beams and the framework. One magnet is placed on each side of the melt.

The water box beam cannot conduct the magnetic field since it consists for the most part of non-magnetic material. When the magnet is arranged between the water box beam and the framework, a longer core which reaches to the copper plate is therefore needed. The core is divided into a rear and a front core, and the front core has been integrated into the water box beam. In this way, the field is conducted through the water box beam.

After a relatively short time of use, the copper plates of the mould are in need of renovation, and then the whole mould is replaced by a renovated mould. Therefore, a plurality of moulds are associated with each continuous casting machine. During the renovation, the water box beam with the copper plate is removed from the mould and the copper plate is renovated. One of the reasons that the magnetic core is divided into a front and a rear part is to facilitate the removal of the water box beam during renovation of the copper plate.

To obtain a magnetic circuit, a magnetic return path is needed. The framework has been rebuilt and supplemented with more iron than what is justified from the point of view of strength, such that it can be utilized as a magnetic return path. The rear core is fixed to the framework. The framework and the cores together form a magnetic circuit.

The mould with magnets rests on a shaking table. To prevent the solidifying melt from adhering to the mould, an oscillating movement is imparted to the shaking table. An attachment device supports the mould and the shaking table. The attachment device does not oscillate along with the shaking table.

Since the rear core is fixed to the framework and the front to the water box beam, a problem arises in that an air gap is created between the movable and fixed parts when the mould is closed. When the mould is open, the air gap is closed. This air gap which separates the front and rear cores gives rise to an electromagnetic force which tends to close the air gap and hence open the mould during the casting. A known solution to this problem is to resist the electromagnetic force by means of hydraulic or mechanical pistons.

It is an object of the invention to suggest a continuous casting machine in which the magnetic field is returned without resulting in any annoying air gap.

SUMMARY OF THE INVENTION

The invention relates to a device for continuously manufacturing a strand by continuous casting of liquid metal, which, inter alia, comprises a mould, open downwards, in the form of cooled copper plates which form a cooled casting mould with a rectangular cross section and where the copper plates are each fixed to a water box beam, which is arranged outside the copper plate to cool and support the copper plate, and a member holding the mould together. The mould is adapted to be supplied with an incoming primary flow of melt.

Magnets are arranged close to the mould and adapted to generate at least one static or periodic low-frequency magnetic field which acts in the path of the inflowing melt and divides the primary flow as well as checks any secondary flows arising. Each magnet comprises at least one magnetically conducting body, a core.

A magnetic return path form together with the magnets a magnetic circuit.

The device further comprises means to impart to the mould an oscillating movement, preferably in the form of a shaking table, and an attachment device with means to support the mould, the magnets and the shaking table.

According to the invention, the magnetically conducting core is divided into a front part, which is a fully integral part of the water box beam, and a rear part which comprises a rear movable part (*6b*) which is movable in a direction which substantially coincides with the direction of the field in the core.

BRIEF DESCRIPTION OF THE DRAWINGS

Various embodiments of a continuous casting machine in which a static or periodic low-frequency magnetic field is arranged for controlling the flow in non-solidified portions of a cast strand are shown in the accompanying figures.

DESCRIPTION OF THE PREFERRED EMBODIMENTS

Figure 1:
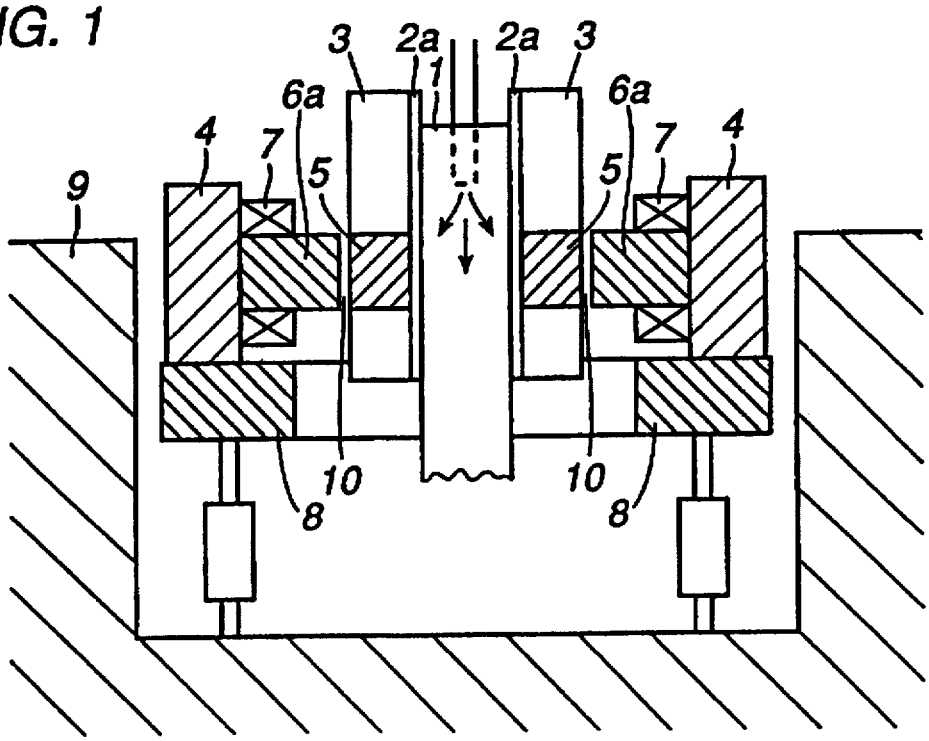
FIG. 1 is a cross section of a continuous casting machine according to the prior art.

FIG. 1 is a cross section of a device for continuous casting of metal according to the description of the background art. The cast strand 1 is formed by molten metal running down into a mould. The mould consists, inter alia, of copper plates 2*a* which are fixed in water beam boxes 3, the task of the latter being to stiffen and cool the copper plates, and a framework 4 holding the mould together and which is designed such that it constitutes a magnetic return path of the magnetic field. To operate as return path for the magnetic field, the framework has, inter alia, been supplemented with a larger quantity of iron than what is justified from the point of view of strength.

The magnets, which bring about a static or periodic low-frequency magnetic field in the melt, comprise a front core 5 which is integrated in the water box beam and a rear core 6*a* around which a coil 7, supplied with an electric direct current or a low-frequency alternating current, is arranged. The rear core is fixed to the framework.

To prevent the melt from adhering to the walls of the mould, an oscillating movement is imparted to the mould by means of a shaking table 8. The oscillating movement can, for example, be obtained by hydraulic pistons. An attachment device 9 supports the mould, the magnets and the shaking table.

During the casting when the mould is closed, an air gap 10 (5–15 mm) arises between the front and rear cores. This air gap causes problems since it gives rise to an electromagnetic force which strives to close the air gap and hence open the mould during the casting. The electromagnetic force causes the front iron core with the water box beam and the copper plate to be attracted towards the framework.

Figure 2:
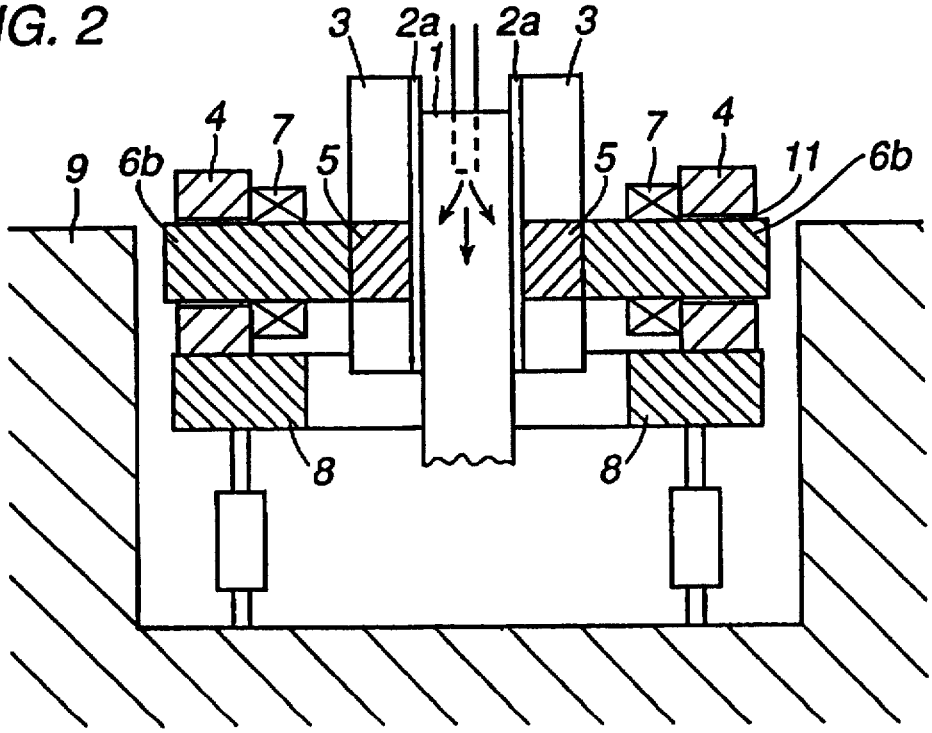
PRIOR ART FIG. 2
FIG. 2 is a cross section and FIG. 4 a view from above of an embodiment of a continuous casting machine in which the rear core is arranged movable in the framework.
Figure 4:
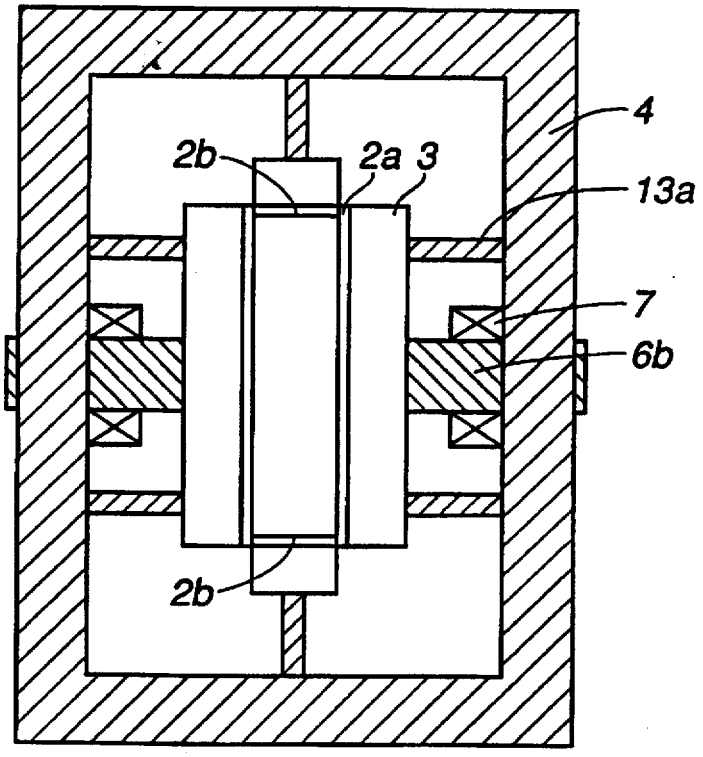

FIG. 2 and FIG. 4 show an embodiment of a continuous casting machine in which the air gap between the front and rear cores is closed also when the mould is closed. The rear core 6*b* has been extended and arranged to be movable in the frame-work 4. The rear core is movable in a direction which substantially coincides with the direction of the field in the core. When the mould is open, the front core exerts a pressure on the rear core, which then moves in the framework. When the mould is closed and the coil is energized, the front and rear cores are pressed against each other by the acting electromagnetic forces. In the framework the core slides in some form of bearing 11, for example of sliding metal.

One reason for the magnetic core still being divided is that the water box beam with the copper plate is often removed from the mould, and this is facilitated if the magnetic core is divided.

FIG. 4 shows the framework with the hydraulic pistons 13*a* which open and close the mould. FIG. 4 also shows the copper plates 2*b*, arranged on the short sides of the mould, which determine the width of the cast strand. Control of the width of the strand takes place by pushing the copper plates 2*b* outwards and inwards. Otherwise, the continuous casting machine is of the same construction as in the embodiment described above. The two rear and the two front cores and the strand form together with the framework a coherent magnetic flux path. The magnets oscillate along with the mould.

In another embodiment, the shaking table of FIG. 2 is designed so as to constitute a magnetic return path for the magnetic field. The two rear and the two front cores form together with the shaking table a coherent magnetic flux path. The shaking table, which is normally an iron structure, needs to be supplemented with more iron to reduce its flux resistance. Since a continuous casting machine has several moulds but only one shaking table per strand, it is an advantage to use the shaking table as a return path instead of the framework, since in that case only one unit need be rebuilt and be supplied with more iron.

In still another embodiment, the attachment device of FIG. 2 is designed so as to constitute a magnetic return path for the magnetic field. The two rear and the two front cores and the strand form together with the attachment device a coherent magnetic flux path. To reduce its flux resistance, the attachment device need to be supplemented with more iron. Means for conducting the magnetic flux from the rear core to the attachment device may also be needed if the air gap therebetween is too large. It is important to reduce the weight of the oscillating parts in the continuous casting machine. Since the attachment device does not oscillate, the weight of the oscillating parts is reduced in this embodiment compared with the case where the framework or the shaking table constitutes the magnetic return path.

Figure 3:
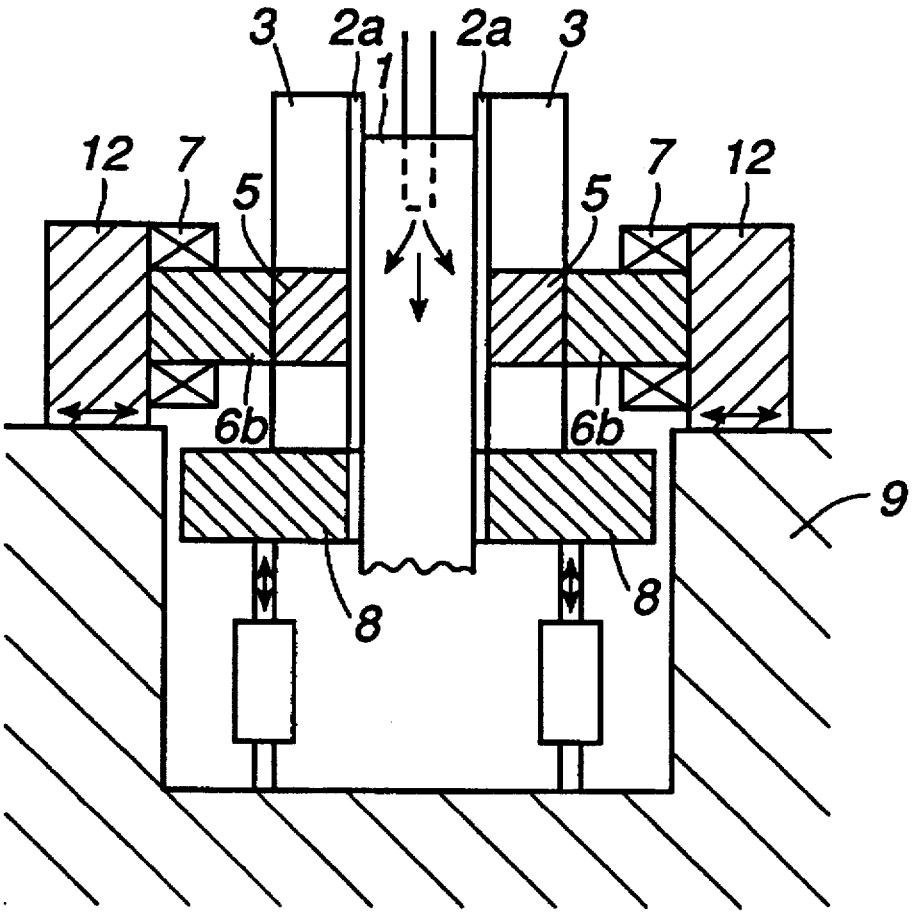
FIG. 3 is a cross section and FIG. 5 a view from above of an embodiment of a continuous casting machine in which the rear core is arranged movable on the attachment device.
Figure 5:
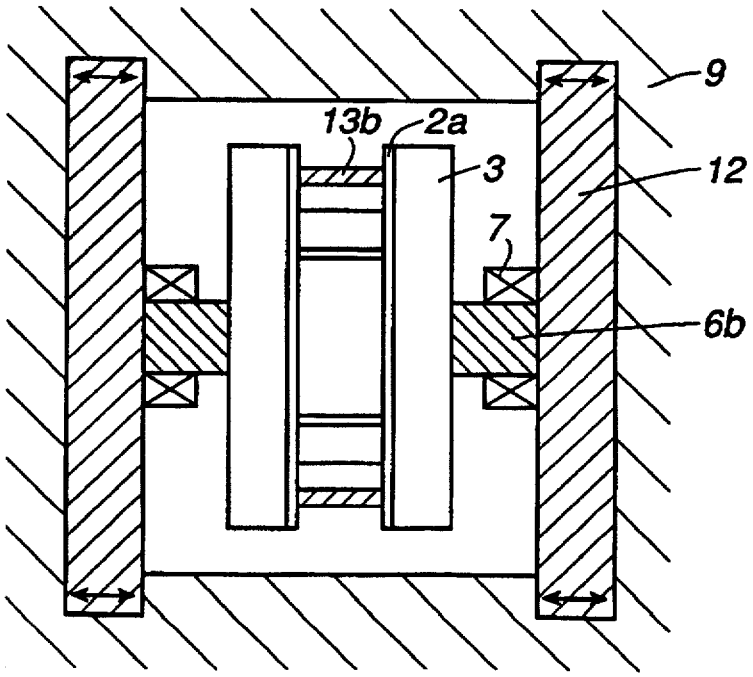

FIGS. 3 and 5 show an embodiment in which the weight of the oscillating parts has been further reduced. In this embodiment of the invention, the rear movable core 6*b* and the coil 7 are arranged near the attachment device 9. Since the rear core and the coil do not follow the oscillating movement, the weight of the oscillating parts is reduced.

The rear core is fixed to a beam 12 which can roll or slide on the attachment device in a horizontal direction. When the mould is opened, the front core exerts a pressure on the rear core and the beam, which then move on the attachment device. When the mould is closed and current is applied to the coil, the front and the rear cores are pressed against each other by the acting electromagnetic forces. The beam moves, for example, in a rail provided with sliding metal and arranged on the attachment device.

When the mould oscillates, the front core moves relative to the rear core in a vertical direction. The maximum deflection of the oscillating movement is small in relation to the size of the cores. The cores slide against each other. To facilitate the sliding, it is possible to arrange, for example, a sliding metal or a journalled roller on the sliding surfaces. The front core oscillates along with the mould. The rear core and the coil do not oscillate.

The attachment device is designed so as to constitute a magnetic return path for the magnetic field. The two rear and the two front cores and the cast strand form together with the attachment device and the beam a coherent flux path.

In this embodiment of the invention there is no framework. As shown in FIG. 5, the retaining member may be draw bars 13*b*, which besides their retaining function open and close the mould.

Figure 6:
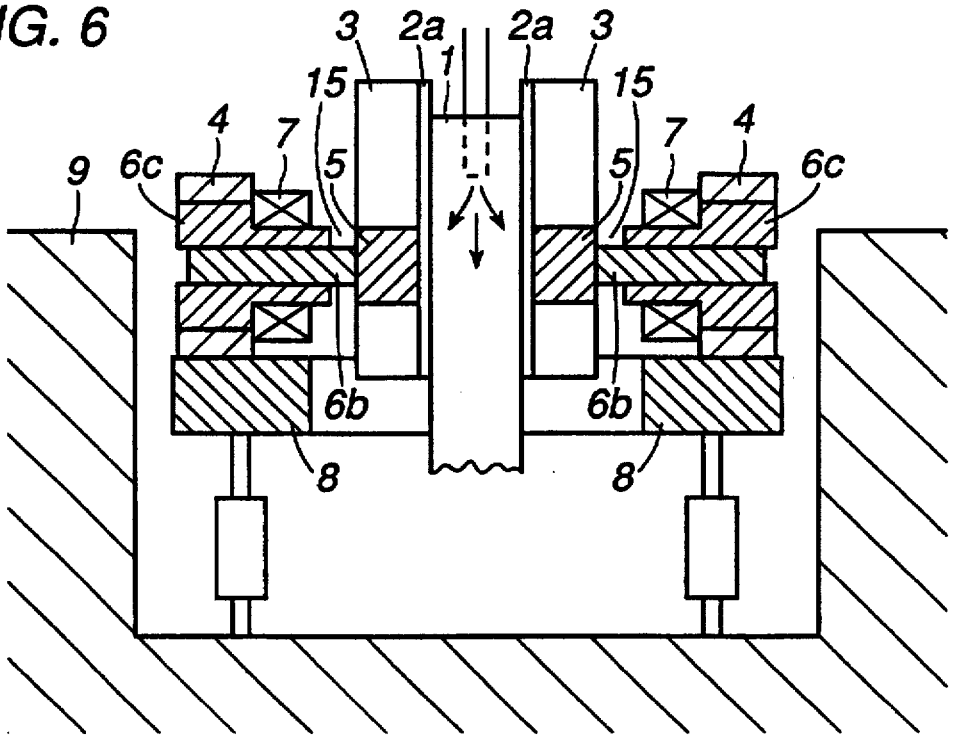
FIG. 6 is a cross section of an embodiment of a continuous casting machine in which the rear core is divided into a fixed part and a movable part.

A problem with using a movable rear iron core is that the electromagnetic forces which press the rear core against the front one also result in the copper plates being pressed against each other. The electromagnetic forces may be so great that there is a risk that the copper is deformed. The forces on the copper plates also make it difficult to control the width of the cast strand during the casting. FIG. 6 shows a device for reducing these magnetic forces. The rear core is divided into a fixed part 6*c* and a movable part 6*b*. Between the front core 5 and the rear fixed part 6*c* there is an air gap 15. The rear fixed part 6*c* of the core together with the air gap 15 gives rise to a force which is directed opposite to the force from the rear movable core and thus reduces the resulting force on the copper plates. The rear fixed part of the core is a fully integral part of the framework 4.

In the embodiment where the front core oscillates and the rear core does not oscillate, their movement relative to each other is made difficult by the magnetic forces which press the rear iron core against the front one. If, for example, a journalled roller is arranged between the front and rear cores to reduce the friction, the roller is subjected to a force which increases its rolling resistance and which may cause material damage to both the core and the roller.

Figure 7:
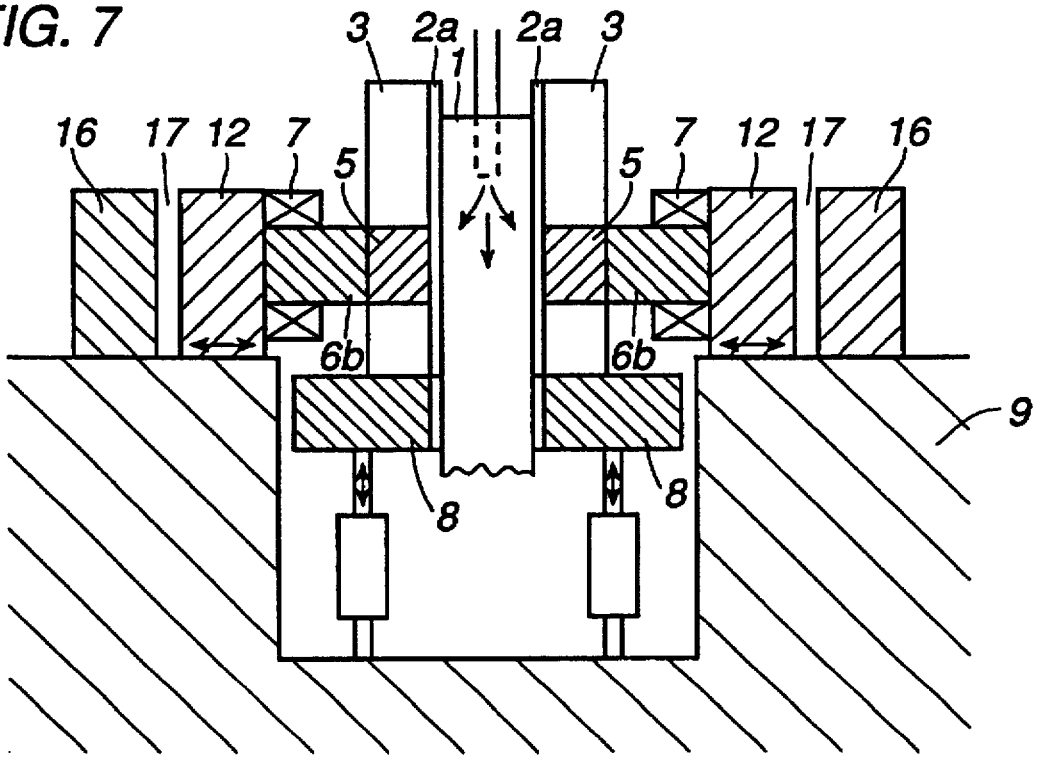
FIG. 7 is a cross section of an additional embodiment of a continuous casting machine in which the rear core is arranged movable on the attachment device.

In FIG. 7 an embodiment is shown where the magnetic force between the front and rear cores is reduced by arranging, on the attachment device behind the rear core in relation to the front core, a magnetically conducting member 16 which constitutes part of the magnetic flux path. Between the magnetically conducting member 16 and the beam 12 to which the rear core is fixed, an air gap 17 is provided. The magnetically conducting member comprises a magnetically conducting material. The magnetically conducting member 16 together with the air gap 17 gives rise to a force which is directed opposite to the force from the rear movable core on the front core. By balancing both the quantity of magnetic material in the magnetically conducting member 16 and the size of the member as well as the width of the air gap 17, the resultant force between the rear and the front core can be reduced to a suitable magnitude. If the force is reduced too much or is given an opposite direction, the mould can be opened during the casting operation.

We claim:

1. A device for the continuous casting of metal comprising:

an attachment device, a shaking table supported on said attachment device, means forming a framework positioned on the shaking table, first and second water box beams positioned in parallel within said framework means, first and second copper plates respectively located on facing surfaces of said first and second water box beams, said first and second copper plates defining a downwardly open mould space therebetween and into which metal melt can be downwardly supplied, first core portions of respective first and second magnets respectively mounted in said first and second water box beams, second core portions of said respective first and second magnets positioned between respective first core portions and said framework means, each said second core portion slidingly extending through a respective opening in said framework means so as to slide in a direction substantially coinciding with a magnetic field direction generated thereby, and first and second magnetic coils respectively positioned around said second core portions of said respective first and second magnets, said second core portions being able to slide away from said mould space when the mould space is opened by movement of said first and second water box beams away from one another, and able to slide towards said mould space and against said first core portions to close said mould space by movement of said first and second water box beams, and with the energization of said first and second magnetic coils said first core portions and said second core portions are pressed against each other, said first and second magnets also generating a static or periodic low-freqency magnet field influencing the metal melt flowing through said mould space.

2. A device according to claim 1, including draw pistons connected between said first and second water box beams and said framework means.

3. A device according to claim 1, wherein said first and second magnets include third core portions fixedly connected in said framework, said second core portions slidingly extending through openings in said respective third core portions.

4. A device for the continuous casting of metal comprising:

an attachment device, a shaking table supported on said attachment device, first and second beams movably positioned on the attachment device, first and second water box beams positioned in parallel on said shaking table and within said first and second beams, first and second copper plates respectively located on facing surfaces of said first and second water box beams, said first and second copper plates defining a downwardly open mould space therebetween and into which metal melt can be downwardly supplied, first core portions of respective first and second magnets respectively mounted in said first and second water box beams, second core portions of said respective first and second magnets positioned between respective first core portions and said respective first and second beams, each of said second core portions being connected to said respective first and second beams so as to slide in a direction substantially coinciding with a magnetic field direction generated thereby, and first and second magnetic coils respectively positioned around said second core portions of said respective first and second magnets, said second core portions being able to slide away from said mould space when the mould space is opened by movement of said first and second water box beams away from one another, and able to slide towards said mould space and against said first core portions to close said mould space by movement of said first and second water box beams, and with energization of said first and second magnetic coils said first core portions and said second core portions are pressed against each other, said first and second magnets also generating a static or periodic low-frequency magnet field influencing the metal melt flowing through said mould space.

5. A device according to claim 4, including first and second magnetically-conducting members respectively positioned adjacent said first and second beams opposite said respective second core portions so as to provide an air gap between said magnetically-conducting members and said beams.

6. A device for the continuous casting of metal comprising:

an attachment device, a shaking table supported on said attachment device, first and second water box beams positioned in parallel and including respective copper plates on facing surfaces thereof to define a downwardly open mould space therebetween and into which metal melt can be downwardly supplied, first core portions of respective first and second magnets respectively mounted in said first and second water box beams, second core portions of said respective first and second magnets located outwardly of said first and second water box beams relative to said mould space, each of said first and second magnets defining a respective magnetic field direction and each of said second core portions being mounted to move in a direction substantially coinciding with its respective magnetic field direction, and first and second magnetic coils respectively positioned around said second core portions of said respective first and second magnets, said second core portions being able to move away from said mould space when the mould space is opened by movement of said first and second water box beams away from one another, and able to move towards said mould space and against said first core portions to close said mould space by movement of said first and second water box beams, and with energization of said first and second magnetic coils said first core portions and said second core portions are pressed against each other, said first and second magnets also generating a static or periodic low-frequency magnet field influencing the metal melt flowing through said mould space.

* * * * *